United States Patent [19]

Derivaz

[11] Patent Number: 4,498,513

[45] Date of Patent: Feb. 12, 1985

[54] PLANE

[75] Inventor: Charles Derivaz, La Tour-de-Peilz, Switzerland

[73] Assignee: Samvaz S.A., Fenil-sur-Vevey, Switzerland

[21] Appl. No.: 565,885

[22] Filed: Dec. 27, 1983

[30] Foreign Application Priority Data

Jan. 24, 1983 [CH] Switzerland ..... 378/83

[51] Int. Cl.[3] ..... B27G 17/02

[52] U.S. Cl. ..... 145/11; 145/5 R; 145/16

[58] Field of Search ..... 145/11, 16, 5 R, 12

[56] References Cited

U.S. PATENT DOCUMENTS 1,527,814 2/1925 Mucha ..... 145/11
1,585,365 5/1926 Binger .

FOREIGN PATENT DOCUMENTS 42731 8/1887 Fed. Rep. of Germany ..... 145/5 R
55296 4/1890 Fed. Rep. of Germany .
495479 4/1930 Fed. Rep. of Germany .
830108 1/1952 Fed. Rep. of Germany .
362750 7/1906 France .
994294 11/1951 France .
1238082 6/1960 France .
101098 9/1923 Switzerland ..... 145/11

*Primary Examiner*—Frederick R. Schmidt
*Assistant Examiner*—J. T. Zatarga
*Attorney, Agent, or Firm*—Young & Thompson

[57] ABSTRACT

A plane comprising a body between the side walls (1,2) of which two soles (3,4) are fixed, the lower faces (14,15) of these soles being located in a common plane. A V-shaped opening is provided between the soles (3,4). A blade-holder mounted on a shaft (20) comprises a lower blade (16), a removable cutting blade (18) and a counter-blade (27) which is linearly displaceable relative to the lower blade (16). An arresting device (13) articulated on the side walls (1,2) maintains, in service position, the blade-holder against a bearing face (12) of the sole (4).

4 Claims, 6 Drawing Figures

FIG. 3
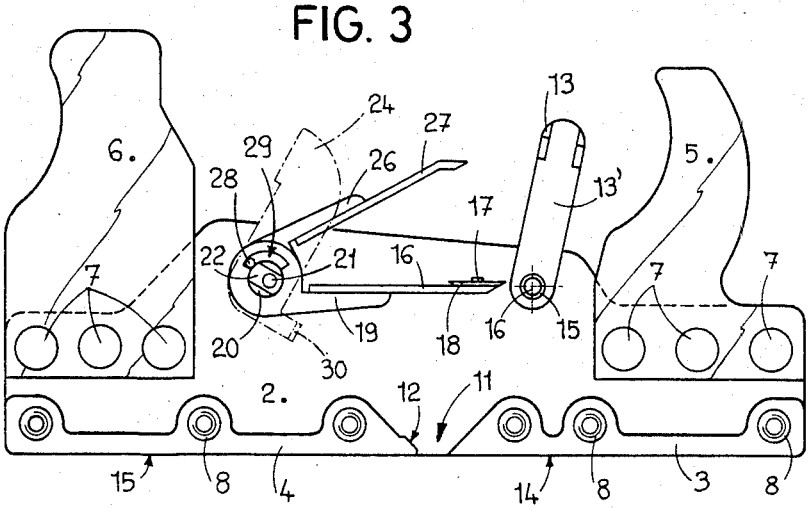
FIG. 2
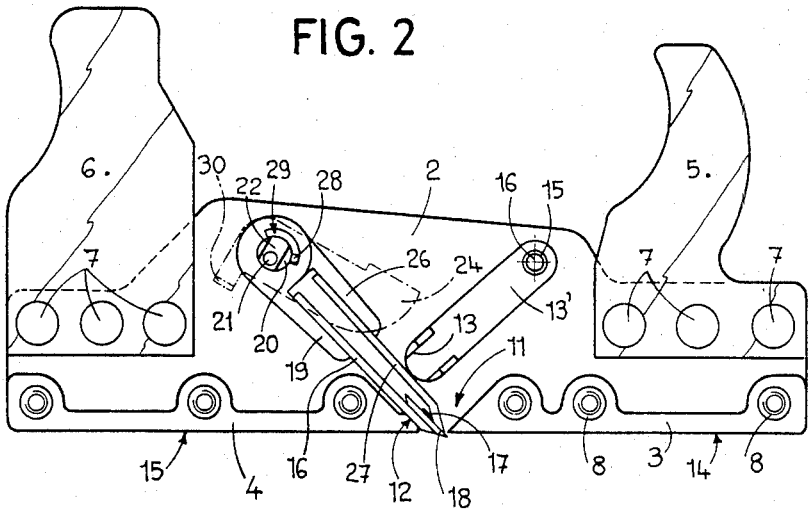
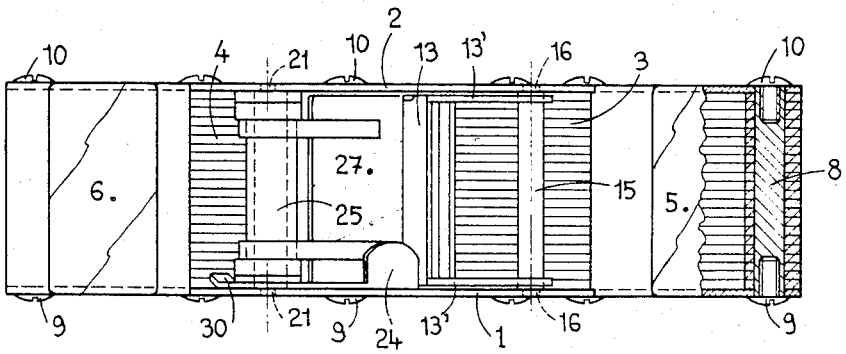
FIG. 1

PLANE

The present invention relates to a plane for the manual working of wood, such as planing wood boards or surfaces, or with the help of smaller planes, the removal of edges or the leveling of edges on wood pieces.

The known planes comprise a body made of wood or metal presenting a through opening, generally of a V-shape, in which a blade and optionally a counter-blade are located, which are fixed in working position by means of a wedge or any other fixing device by wedging of the blades against the body.

These planes having several drawbacks, the main one being the lack of precision in the adjustment of the position of the blade with regards to the sole of the body. As a matter of fact, this adjustment is carried out visually, so it is then very difficult to wedge the blade in its desired position. The cutting edge of this blade often protrudes too much or not enough from the sole of the plane body and, what is still more serious, it is rather impossible to position the cutting edge of the blade in a plane rigorously parallel to the sole of the plane, and thereby the thickness of the chips is not uniform along its whole length.

The object of the present invention is to provide a plane intended to prevent the above drawbacks of the known planes, and which is characterized by the fact that it comprises a blade-holder mounted on an axle journalled between the side walls, said blade-holder comprising a lower blade having positioning means of a removable cutting blade and a counter-blade angularly displaceable with regards to said lower blade; by the fact that the axle of the blade-holder has a part which is offset from its trunnions pivoted in the side walls of the body; by the fact that a working lever controls the rotations of said axle and thereby the motion of the blade-holder perpendicularly to said axle, and by the fact that it comprises an arresting device articulated on the side walls and maintaining, in service position, the blade-holder against a bearing face of the back sole.

The annexed drawing illustrate schematically and by way of example a particular embodiment of the plane according to the invention.

FIG. 1 is a view from above of the plane.

FIG. 2 is a side view, without the side wall, and in service position.

FIG. 3 is a side view, without the side wall, in opened position allowing the change of the cutting blade.

Figure 5:
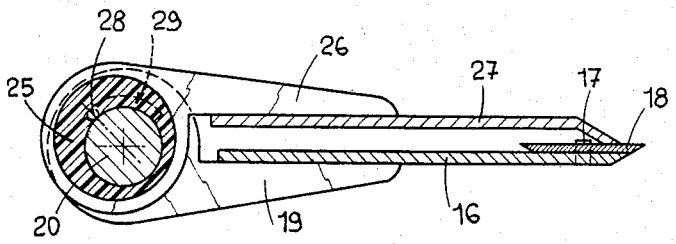
FIGS. 5 and 6 show in cross-section the blade and the counter-blade in two extreme relative positions.

The plane as shown comprises a body constituted of two side walls 1,2 cut out of metal sheet and between which a front sole 3 and a back sole 4 are located, both soles being formed by a stock of cut out metal sheets, as well as a front handle 5 and a back handle 6 made of plastic material and both presenting lateral projections 7 cooperating with corresponding apertures in the side walls. The body thus formed is made monolithic by means of rods 8 having their end threaded and which are introduced into borings provided in the side walls 1,2 and in the soles 3, 4 and by screws 9, 10 screwed in these rods 8 and bearing on the external face of said side walls 1, 2.

A V-shaped opening 11 is provided in the middle part of the plane between the front sole 3 and the back sole 4, the back face of said opening being formed by the front face 12 of the back sole 4 used as bearing face of a blade-holder, as it will be seen farther on.

A recess is located between the side walls 1,2, the handles 5,6 and above the soles 3,4, in which an arresting device and a blade-holder with its adjusting device are located and pivoted between said walls 1,2 of the body.

The arresting device is constituted of a stirrup the middle portion 13 of which has a rounded surface intended to enter into contact with the counter-blade, as explained hereafter, and the arms 13' of which are pivoted on an axle 15 having its ends 16 of smaller diameter lodged in corresponding borings in the side walls 1,2. This axle 15 is disposed perpendicularly to both lateral walls 1,2, in such a manner that during its angularly oscillating movement the middle portion 13 of the stirrup is displaced parallel to the sole of the plane formed by the lower surfaces 14,15 of the soles 3,4.

The blade-holder comprises a lower blade 16 having on its upper face and near to its front end two pins 17 cooperating with borings provided in a removable and reversible blade 18 which presents two cutting edges. In service position, the blade 18 extends beyond the lower blade 16 with one of its cutting edges. This lower blade 16 of the blade-holder comprises two legs 19 journalled on a shaft 20 extending between both sides walls 1,2 and having at its ends offset trunnions 21 pivoted in corresponding borings in said side walls 1,2. One of the ends of said shaft 20 comprises a rectangular protrusion 22 engaged within an opening 23 of a corresponding shape in a working lever 24.

Figure 6:
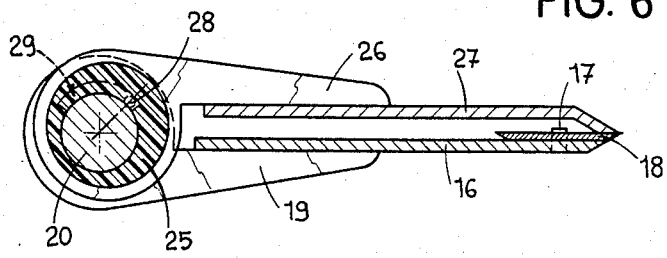
Figure 4:
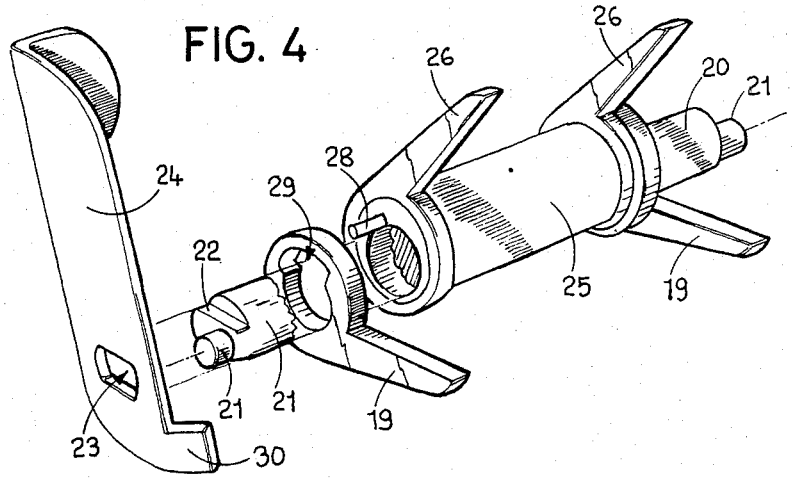
FIG. 4 is an exploded view of the adjusting device of the relative position of the blade and of the counter-blade as well as of the cutting depth.

A sleeve 25, the axial boring of which is offset with regards to its external cylindrical surface, is rotatively mounted on the shaft 20 between both legs 19 and is rotated by the fingers of the user. Supporting elements 26 are journalled on the external cylindrical surface of the sleeve 25 and carry a counter-blade 27. In service position (FIGS. 2,5 and 6), the counter-blade is applied against the lower blade 16 and strongly pinches the blade 18 in order to maintain it in position. By turning the sleeve 25 on itself about the shaft 20, the counter-blade 27 slides with regards to the lower blade 16 so as to modify the free width of the cutting edge of the blade 18, thereby to define the size of the chips.

The blade-holder is swung against the bearing face 12 (FIG. 2), and then the stop 13 is applied against the counter-blade. Finally, by means of the lever 24 acting on the offset shaft 20, the cutting depth is determined by more or less advancing the cutting blade 17 under the plane of the soles 14,15. This lowering movement of the blade-holder causes its wedging through the stirrup 13,13'.

The fastening of the blade is thus very rapid and furthermore the cutting edge of the blade 18 can be displaced only parallel to the sole 14,15 of the plane. Finally, the adjustment of the cutting depth is very fine and precise.

The setting device of the position of the counter-blade 27 with regards to the blade 16 further comprises a stop formed by a rod 28 confined in the sleeve 25 and moving in the slots 29 thus limiting the amplitude of the angular displacement of the sleeve 25 with regards to the shaft 20.

Finally, the rotation of the shaft 20 with regards to the lower blade 16 of the blade-holder is limited by a stop 30 of the lever 24 coming into contact with a leg 19 of the lower blade 16.

The plane as described above has several advantages:

1. The setting of the blade is mechanical and precise.
2. The cutting blade is removable, interchangeable and reversible.
3. The adjustment of the cutting depth and of the free width of the cutting blade, both mechanical and precise, are independant the one with respect to the other.
4. The handling of the plane is very simple.
5. Its manufacture is easy and not expensive because its production from cut out or dished iron sheet.

Several variants of the plane described can be proposed, especially with regards to the shape and the size of the body thereof, the blade-holder and its mechanical adjusting devices as well as the arresting device being the same.

I claim:

1. Plane comprising a body having two parallel side walls (1,2) disposed on either side of a front sole (3) and a back sole (4), the lower faces of said soles (14,15) being located in a common plane and said soles defining between them an opening having the general shape of a V, a blade-holder pivotally mounted on an axle (20) journalled between the side walls, said blade-holder comprising a lower blade (16) having a forward free end having thereon positioning means (17) for a cutting blade (18); a removable cutting blade (18) having locating means cooperating with said positioning means (17); said blade-holder also comprising a counter-blade (27) angularly displaceable relative to said lower blade (16); said axle (20) of the blade-holder (21) having trunnions pivoted in said side walls (1,2), said axle (20) comprising a central part which is eccentric to said trunnions (21); a working lever (24) angularly fast with said axle (20) to control the rotation of said axle (20) and thereby the displacement of the blade-holder perpendicularly to said axle (20), an arresting device (13) articulated on the side walls (1,2) and pinching strongly the cutting-blade (18) between the lower blade (16) and the counter-blade (27) and maintaining, in service position, the blade-holder against a bearing face (12) of the back sole (4); said counter-blade (27) being displaceable linearly with respect to said lower blade (16) to modify the free width of the cutting edge of the cutting blade (18), and control means controlling said linear displacement of said counter-blade (27).

2. Plane according to claim 1, in which said control means comprises an eccentric sleeve (25) rotatably mounted around the central part of the axle (20), said counter-blade (27) being rotatably mounted on said sleeve (25), whereby rotation of the sleeve (25) on the axle (20) effects linear displacement of the counter-blade (27) relative to the lower blade (16) perpendicularly to said axle (20).

3. Plane according to claim 2, and a stop, formed by a rod (28) rotating together with the sleeve (25), and the ends of which stop cooperate with notches (29) in pivoting members (19) of the lower blade (16), said stop limiting the amplitude of the relative angular displacement between the axle (20) and the sleeve (25).

4. Plane according to claim 1 in which the cutting-blade (18) is reversible and comprises two parallel cutting edges; said locating means comprising holes through said cutting blade (18), said holes having a diameter corresponding to that of pins comprising said positioning means (17) extending perpendicularly from the upper face of said lower blade (16) and passing through said holes of said cutting-blade (18).

* * * * *